US006116925A

United States Patent [19]

Tung

[11] Patent Number: 6,116,925

[45] Date of Patent: Sep. 12, 2000

[54] STACKED ELECTRICAL CARD CONNECTOR

[75] Inventor: Shun-Chi Tung, Tu-Chen, Taiwan

[73] Assignee: Hon Hai Precision Ind. Co., Ltd., Taipei Hsien, Taiwan

[21] Appl. No.: 09/389,876

[22] Filed: Sep. 2, 1999

[30] Foreign Application Priority Data

May 15, 1999 [TW] Taiwan ..... 88207772

[51] Int. Cl.[7] ..... H01R 13/648

[52] U.S. Cl. ..... 439/101; 439/607

[58] Field of Search ..... 439/79, 541.5, 439/607, 609, 108, 101

[56] References Cited

U.S. PATENT DOCUMENTS 5,286,207 2/1994 McHugh ..... 439/541.5

5,688,130 11/1997 Huang ..... 439/541.5

5,964,597 10/1999 Hirata et al. ..... 439/607

*Primary Examiner*—Hien Vu

*Attorney, Agent, or Firm*—Wei Te Chung

[57] ABSTRACT

An electrical card connector comprises top and bottom headers stacked together, four rows of contacts extending through the top and bottom headers, and top and bottom grounding plates respectively attached to the top and bottom headers. The top grounding plate includes a first body adapted for connecting with an electrical card, a first grounding portion, and a connecting portion formed between the first body and the first grounding portion. The bottom grounding plate is connected with the first grounding portion of the top grounding plate. The bottom grounding plate includes a second body adapted for connecting with an electrical card and a second grounding portion extending from the second body.

5 Claims, 4 Drawing Sheets

STACKED ELECTRICAL CARD CONNECTOR

BACKGROUND OF THE INVENTION

1. Field of the Invention

The present invention relates to an electrical card connector, and particularly to a stacked electrical card connector having a pair of grounding plates securely attached thereto.

2. Description of Prior Art

As the computer industry develops, higher quality signal transmission is desired. Thus, many electrical card connectors have grounding plates attached thereto for preventing electromagnetic disturbances, as disclosed in Taiwan patent application Nos. 85216014, 85214724 and 84112508.

Referring to FIG. 1, a conventional electrical card connector 100 is mounted on a printed circuit board (PCB) 102 by a transition device 104. The electrical card connector 100 includes a pair of headers 106, four rows of contacts 108 extending through the headers 106, and three grounding plates 110 attached to surfaces of the headers 106. The transition device 104 includes a transition connector 112 and a transition circuit board 114 connected with the transition connector 112. The four rows of the contacts 108 and the three grounding plates 110 are mounted to the transition circuit board 114.

However, to promote miniaturization, a distance H1 between the electrical card connector 100 and the PCB 102 must be reduced.

SUMMARY OF THE INVENTION

Accordingly, an object of the present invention is to provide an electrical card connector having stacked headers and engaged grounding plates for promoting a reduced height of the connector.

In order to achieve the object set forth, an electrical card connector in accordance with the present invention comprises top and bottom headers stacked together, four rows of contacts extending through the top and bottom headers, and top and bottom grounding plates respectively attached to the top and bottom headers. The top grounding plate includes a first body adapted for connecting with an electrical card, a first grounding portion, and a connecting portion formed between the first body and the first grounding portion. The bottom grounding plate is connected with the first grounding portion of the top grounding plate. The bottom grounding plate includes a second body adapted for connecting with an electrical card and a second grounding portion extending from the second body.

BRIEF DESCRIPTION OF THE DRAWINGS

Other objects and advantages of the present invention will be understood from the following description of an electrical card connector according to a preferred embodiment of the present invention shown in the accompanying drawings, in which.

DETAILED DESCRIPTION OF THE PREFERRED EMBODIMENT

Figure 1:
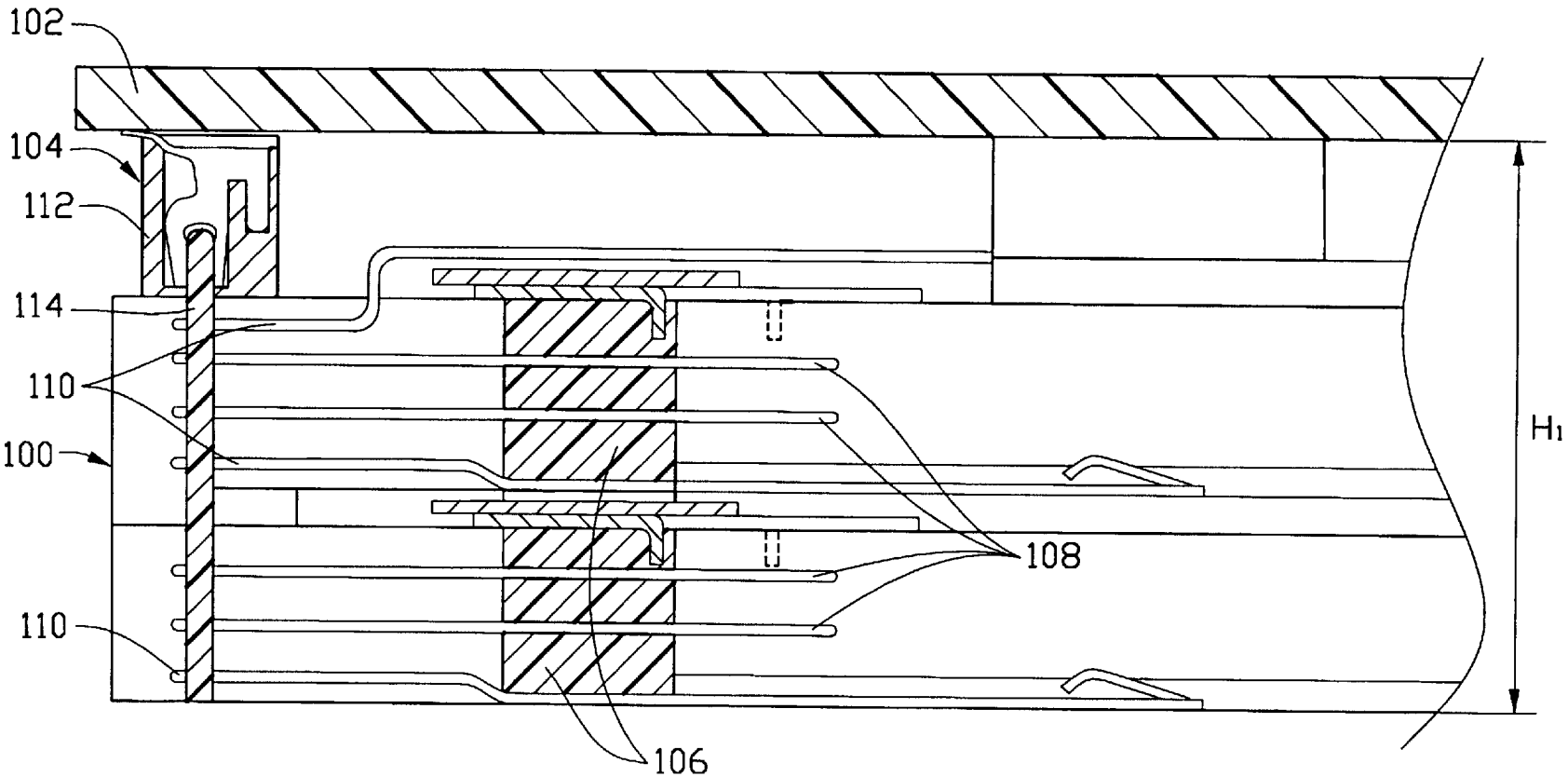
FIG. 1 (PRIOR ART)
FIG. 1 is a cross sectional view of a conventional electrical card connector.
Figure 2:
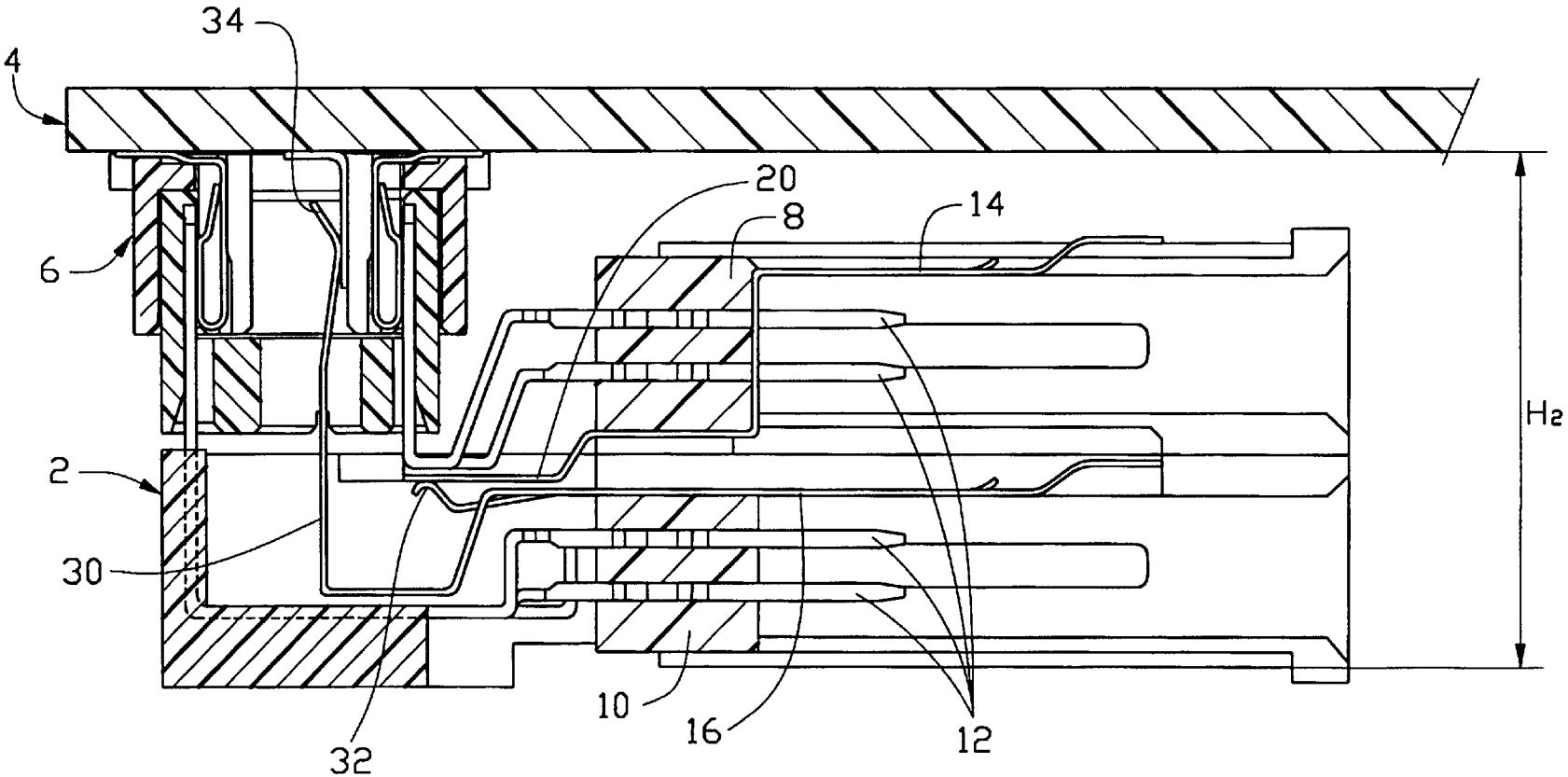
FIG. 2 is a cross sectional view of an electrical card connector embodying the concepts of the present invention.
Figure 3:
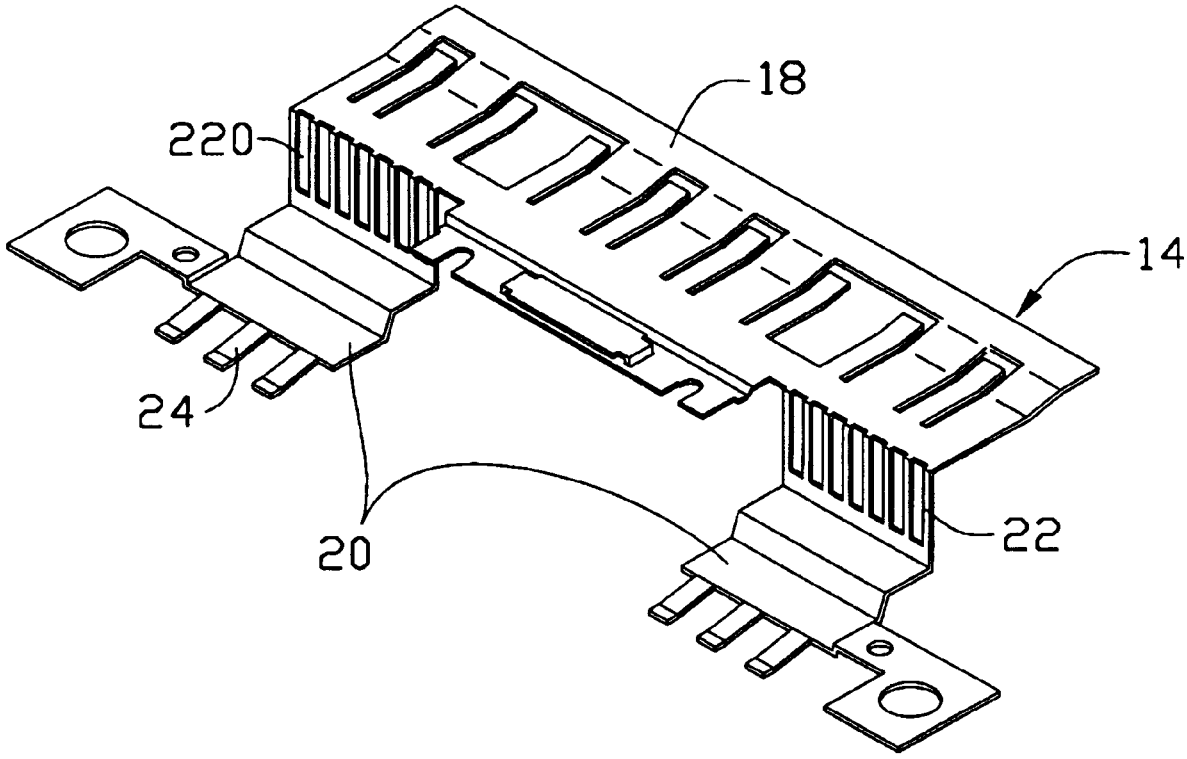
FIG. 3 is a perspective view of a top grounding plate embodying the concepts of the present invention.
Figure 4:
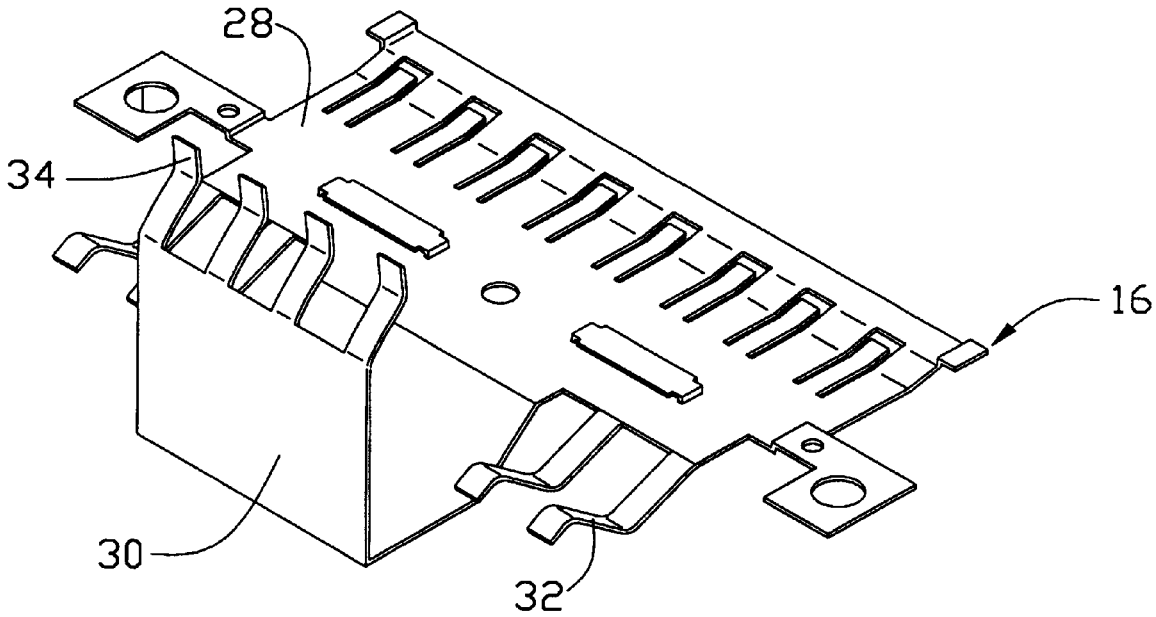
FIG. 4 is a perspective view of a bottom grounding plate embodying the concepts of the present invention.

Referring to FIGS. 2–4, a stacked electrical card connector 2 in accordance with the present invention is mounted to a printed circuit board (PCB) 4 by a transition device 6 wherein the basic structures of the stacked electrical card connector assembly can be referred to the copending application Ser. No. 09/357,461 filed Jul. 20, 1999 with the same applicant and the same assignee thereof.

The electrical card connector 2 comprisis top and bottom headers 8, 10 stacked together, four rows of contacts 12 extending through the top and the bottom headers 8, 10, and top and bottom grounding plates 14, 16 attached to the top and bottom headers 8, 10. The contacts 12 are arranged in two rows to engage with the transition device 6. The top grounding plate 14 contacts the bottom grounding plate 16 which engages with the transition device 6. Thus, a distance H2 between the electrical card connector 2 and the PCB can be reduced since the top grounding plate 14 does not directly engage with the transition device 6.

The top grounding plate 14 includes a first body 18 for connecting with an electrical card (not shown), a pair of first grounding portions 20, and a pair of connecting portions 22 formed between the first body 18 and the first grounding portions 20. The connecting portion 22 defines a plurality of slots 27 for allowing extension of the contacts 12 retained in the top header 8. The connecting portions 22 perpendicularly extend from the first body 18 for positioning the first grounding portions 20 at a bottom side of the top header 8. Each first grounding portion 20 forms a plurality of first spring fingers 24 extending therefrom.

The bottom grounding plate 16 includes a second body 28 for connecting with an electrical card, a second grounding portion 30 extending from a center portion of the second body 28, and a plurality of second spring fingers 32 extending from the second body 28 for engaging with the first spring fingers 24 of the top grounding plate 14. The second grounding portion 30 forms a plurality of spring tabs 34 extending therefrom for engaging with the grounding terminal 62 of the transition device 6 to provide grounding capabilities.

In assembly, the top and bottom grounding plates 14, 16 are attached to the top and bottom headers 8, 10, respectively. The top grounding plate 14 does not directly engage with the transition device 6 but contacts the bottom grounding plate 16 via the first spring fingers 24 of the first grounding portion 20 thereof engaging with the second spring fingers 32 of the bottom grounding plate 16. The spring tabs 34 of the bottom grounding plate 16 engage with the transition device 6 for grounding both the top and bottom grounding plates 14, 16. Thus, the distance H2 between the electrical card connector 2 and the PCB 4 can be reduced since the top grounding plate 14 does not directly engage with the transition device 6.

It is understood that the invention may be embodied in other specific forms without departing from the spirit of the central characteristics thereof. Thus, the present examples and embodiments are to be considered in all respects as illustrative and not restrictive, and the invention is not to be limited to the details given herein.

What is claimed is:

1. An electrical card connector comprising:

top and bottom headers stacked together;

a plurality of rows of contacts extending through the top and bottom headers, respectively;

a top grounding plate attached to the top header, the top grounding plate including:

a first body positioning at a top side of the top header and adapted for connecting with an electrical card;

a first grounding portion positioning at a bottom side of the top header and forming a plurality of first spring fingers; and a connecting portion being formed between the first body and the first grounding portion, the connecting portion defining a plurality of slots for allowing extension of the contacts retained in the top header; and a bottom grounding plate attached to the bottom header, the bottom grounding plate including:

a second body adapted for connecting with an electrical card, a plurality of second spring fingers extending from the second body to contact the first spring fingers of the top grounding plate; and a second grounding portion extending from the second body adapted for providing grounding capabilities.

2. The electrical card connector as described in claim 1, wherein the connecting portion is perpendicular to the first body.

3. The electrical card connector as described in claim 1, wherein the second grounding portion forms a plurality of spring tabs adapted for the grounding of the bottom grounding plate.

4. An electrical card connector assembly comprising:

top and bottom headers stacked together and electrically connected to a printed circuit board via a transition device;

a plurality of contacts, in rows, extending through each of said top and bottom headers;

a top grounding plate attached to the top header;

a bottom grounding plate attached to the bottom header; wherein one of said top grounding plate and said bottom grounding plate includes grounding portions extending rearwardly and upwardly to mechanically and electrically engage a grounding terminal of said transition device which is mounted to the printed circuit board, and said top grounding plate and said bottom grounding plate mechanically and electrically engage each other in a position around a rear portion of the stacked headers and between the contacts of the top header and the bottom header; and wherein said top grounding plate has vertical connection portions generally abutting against an inner surface of the top header.

5. The connector assembly as claimed in claim 4, wherein said connection portions further define a plurality of slots therein to allow contacts of the top header to extend therethrough.

* * * * *